US008997262B2

(12) United States Patent
Klein

(10) Patent No.: US 8,997,262 B2
(45) Date of Patent: Apr. 7, 2015

(54) PERSONAL LOAD-CARRYING SYSTEM

(76) Inventor: Phillip Alex Klein, Denver, CO (US)

( * ) Notice: Subject to any disclaimer, the term of this patent is extended or adjusted under 35 U.S.C. 154(b) by 57 days.

(21) Appl. No.: 13/884,546

(22) PCT Filed: Apr. 14, 2012

(86) PCT No.: PCT/US2012/033702
§ 371 (c)(1),
(2), (4) Date: May 9, 2013

(87) PCT Pub. No.: WO2012/142544
PCT Pub. Date: Oct. 18, 2012

(65) Prior Publication Data

US 2013/0312150 A1 Nov. 28, 2013

Related U.S. Application Data

(60) Provisional application No. 61/475,654, filed on Apr. 14, 2011.

(51) Int. Cl.

| | |
|---|---|
| ***A41D 13/00*** | (2006.01) |
| ***A45F 3/06*** | (2006.01) |
| ***A45F 3/08*** | (2006.01) |
| ***A45F 3/10*** | (2006.01) |
| ***A45F 3/14*** | (2006.01) |
| ***F41H 1/02*** | (2006.01) |
| *A41D 3/00* | (2006.01) |
| *A45F 3/04* | (2006.01) |

(52) U.S. Cl.
CPC ... *A45F 3/06* (2013.01); *A45F 3/08* (2013.01); *A45F 3/10* (2013.01); *A45F 3/14* (2013.01); *F41H 1/02* (2013.01); *A45F 2003/045* (2013.01); *A45F 2003/144* (2013.01)

(58) Field of Classification Search
USPC ..... 2/94, 108, 85, 92, 95, 69, 2.5, 455; 224/153, 631, 632, 577–581, 586, 628, 224/182, 575, 201, 637–639, 602–610, 224/633; 383/4; 89/907, 36.05, 36.01, 921, 89/926, 937
See application file for complete search history.

(56) References Cited

U.S. PATENT DOCUMENTS

| | | | | |
|---|---|---|---|---|
| 4,114,788 | A | 9/1978 | Zufich | |
| 4,286,739 | A | 9/1981 | Silcott et al. | |
| 4,318,502 | A | 3/1982 | Lowe et al. | |
| 4,676,418 | A | 6/1987 | Lowe | |
| 4,738,383 | A | 4/1988 | Dearborn et al. | |
| 4,830,245 | A * | 5/1989 | Arakaki | 224/628 |
| 4,871,101 | A | 10/1989 | Bunz et al. | |
| 4,896,804 | A | 1/1990 | Dearborn et al. | |

(Continued)

FOREIGN PATENT DOCUMENTS

WO WO-9105494 A1 5/1991

*Primary Examiner* — Gloria Hale
(74) *Attorney, Agent, or Firm* — Leyendecker & Lemire, LLC

(57) ABSTRACT

Personal load-carrying systems are described. Embodiments include a waist belt having a pocket within which a support panel sets. An upper portion of the support panel resides in a sleeve coupled to a backpack or ballistic garment. The support panel thus supports some of the weight of the backpack or ballistic garment and transfers the load to the waist belt. Embodiments include personal load-carrying systems in which a backpack and ballistic garment use the same waist belt and support panel, and are interchangeable thereupon. Variations include personal load-carrying systems in which a ballistic garment and backpack are worn simultaneously.

20 Claims, 10 Drawing Sheets

(56) References Cited

U.S. PATENT DOCUMENTS

| | | | | | |
|---|---|---|---|---|---|
| 4,911,346 | A | | 3/1990 | Shallman | |
| 5,060,314 | A | * | 10/1991 | Lewis | 2/2.5 |
| 5,184,763 | A | | 2/1993 | Blaisdell et al. | |
| 5,378,084 | A | * | 1/1995 | Walters et al. | 405/186 |
| 5,465,886 | A | | 11/1995 | Scherer | |
| 5,492,255 | A | | 2/1996 | Gansky et al. | |
| 5,562,236 | A | | 10/1996 | Monzingo | |
| 5,590,825 | A | | 1/1997 | Murdock | |
| 5,615,812 | A | | 4/1997 | Martin | |
| 5,644,792 | A | * | 7/1997 | Tishler et al. | 2/2.5 |
| 5,725,139 | A | * | 3/1998 | Smith | 224/637 |
| 5,762,243 | A | | 6/1998 | McMaster et al. | |
| 5,806,740 | A | | 9/1998 | Carlson | |
| 5,829,653 | A | * | 11/1998 | Kaiser | 224/577 |
| 5,836,489 | A | | 11/1998 | Swetish | |
| 5,909,802 | A | * | 6/1999 | Puco et al. | 2/102 |
| 5,954,253 | A | | 9/1999 | Swetish | |
| 5,971,244 | A | | 10/1999 | Jaeger | |
| 6,161,738 | A | * | 12/2000 | Norris | 224/153 |
| 6,276,584 | B1 | | 8/2001 | McLachlan | |
| 6,295,650 | B1 | * | 10/2001 | Baacke | 2/94 |
| 6,321,959 | B1 | | 11/2001 | Howell | |
| 6,419,132 | B1 | * | 7/2002 | Reed et al. | 224/153 |
| 6,550,651 | B1 | * | 4/2003 | Murdoch et al. | 224/153 |
| 6,607,108 | B2 | | 8/2003 | Mydans | |
| 6,626,342 | B1 | | 9/2003 | Gleason | |
| 6,886,727 | B2 | | 5/2005 | Moore | |
| 7,287,677 | B2 | | 10/2007 | Reid | |
| 7,673,777 | B2 | | 3/2010 | Gleason, Jr. | |
| 7,712,148 | B2 | * | 5/2010 | Carlson | 2/2.5 |
| 7,770,769 | B2 | | 8/2010 | Hurn | |
| 8,182,439 | B2 | | 5/2012 | Glenn | |
| 8,387,166 | B2 | * | 3/2013 | Eastep | 2/102 |
| 2002/0108982 | A1 | | 8/2002 | Mydans | |
| 2003/0106916 | A1 | | 6/2003 | Boone | |
| 2003/0127483 | A1 | | 7/2003 | Black | |
| 2005/0035170 | A1 | | 2/2005 | Sears et al. | |
| 2005/0092802 | A1 | | 5/2005 | Maley | |
| 2006/0011689 | A1 | | 1/2006 | Reid | |
| 2006/0208024 | A1 | | 9/2006 | Gleason, Jr. | |
| 2006/0289589 | A1 | | 12/2006 | Gregory | |
| 2008/0035695 | A1 | | 2/2008 | Hurn | |
| 2008/0041906 | A1 | | 2/2008 | Rose et al. | |
| 2008/0142562 | A1 | | 6/2008 | Cheng | |
| 2008/0302839 | A1 | | 12/2008 | Murdoch et al. | |
| 2009/0057360 | A1 | | 3/2009 | Demsky | |
| 2009/0302075 | A1 | | 12/2009 | Trainer | |
| 2010/0032464 | A1 | | 2/2010 | Gleason, Jr. | |
| 2010/0176172 | A1 | | 7/2010 | Gleason, Jr. | |
| 2010/0243693 | A1 | | 9/2010 | Terry et al. | |
| 2013/0047320 | A1 | | 2/2013 | Gleason | |
| 2013/0261521 | A1 | | 10/2013 | Carter | |

* cited by examiner

PERSONAL LOAD-CARRYING SYSTEM

The present application claims priority to and incorporates by reference U.S. provisional Patent Application No. 61/475,654, filed 14 Apr. 2011, having the same inventor as the present application and the title "MODULAR LOAD CARRYING SYSTEM."

BACKGROUND

People frequently carry substantial loads on their persons. Hikers, backpackers, skiers, and military personnel often use backpacks to carry loads. For backpacks lacking waist belts, the load is borne largely on the user's shoulders and back. For backpacks having waist belts, the load is typically shared between the user's shoulders and hips. Backpacks with frames, be they internal or external, are generally better than frameless packs at supporting and stabilizing large loads. Some backpacks utilize quasi-frames comprising wands inserted into pack receptacles, for supporting and stabilizing medium size loads without incurring the increased weight or range of motion limitations typical of more extensive frames.

A person who engages in a variety of outdoor recreational activities can require a relatively large collection of backpacks in order to have a backpack optimized for each activity. A lightweight pack having no waist belt or frame may be optimal for short day hikes or skiing inbounds at ski areas. A larger pack having a waist belt but no frame, or only carbon fiber wands for load stabilization, may be better for larger day hikes, backcountry skiing, and single overnight trips. For multi-day backpacking, a larger backpack having a substantial frame and waist belt may be ideal. Where a backpacker anticipates being out for a week or more, a super-large pack with a heavy duty belt and frame may be called for.

Military and law enforcement personnel frequently wear body armor such as ballistic vests, bulletproof vests, and flak jackets. The user's shoulders and back typically bear most of the weight of body armor. Military personnel frequently wear heavily loaded backpacks, and thus benefit from backpacks equipped with internal frames, external frames, quasi-frames, or other structural members that are rigid or semi-rigid and that assist in transferring some of the backpack load to a waist belt. However, the backpack frames are generally not adapted for use with body armor, with which a different frame or other support member, or no frame or support member, is employed. Moreover, backpack frames frequently restrict movement of the user because the frames are coupled to a waist belt and thus have little movement independent of the waist belt. For these and other reasons, military personnel sometimes carry very heavy backpacks in the absence of frames or other structural members that assist in transferring load to the users' hips, and back injuries from bearing heavy loads are consequently relatively common. Health care costs for the United States military related to such back injuries are large.

Military personnel sometimes need to wear body armor and carry a backpack simultaneously. With the load of body armor being carried primarily by the user's shoulders and thus transferred to the user's back, combining the backpack load with the weight of a ballistic garment can be most uncomfortable for the user. Back injuries can also be induced by this arrangement.

DETAILED DESCRIPTION

Figure 1:
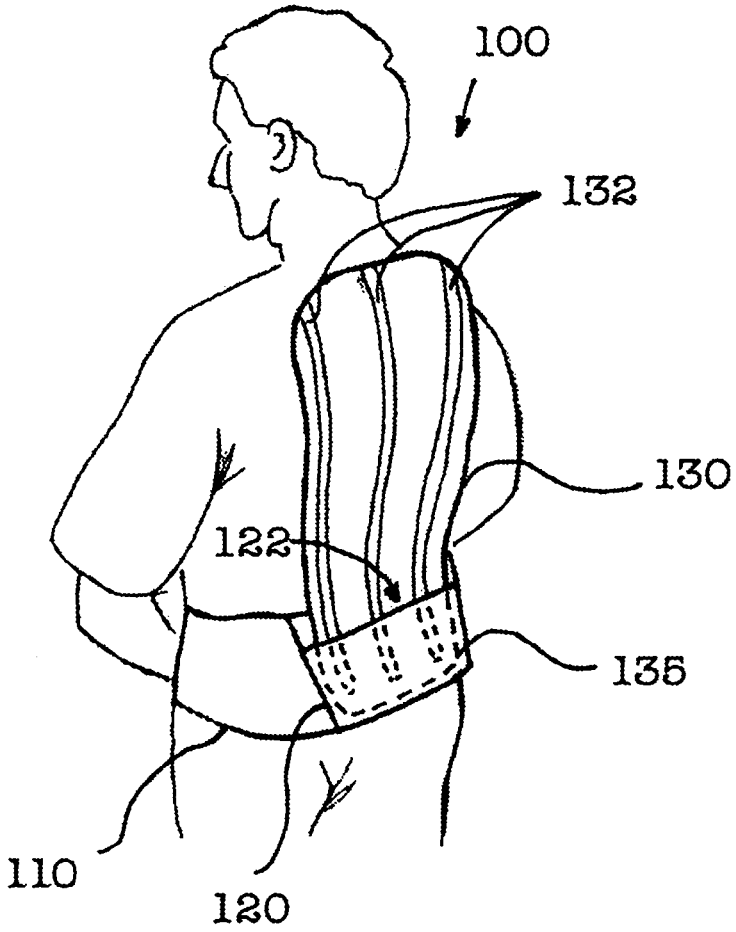
FIG. 1 is a side, back perspective view of a personal load-carrying system according to an exemplary embodiment of the present invention.

Embodiments of the present invention include a personal load-carrying system comprising a waist belt having a panel pocket that bears a support panel, with a tail portion of the panel residing in the panel pocket. An upper portion of the support panel resides in a sleeve coupled to a backpack or ballistic garment, such that the support panel supports some of the weight of the backpack or ballistic garment and transfers the load to the waist belt. Embodiments include personal load-carrying systems in which a backpack and ballistic garment use the same waist belt and support panel, and are interchangeable thereupon. Variations include backpacks and ballistic garments adapted to use with or without the waist belt or support panel. Backpacks and ballistic garments of personal load-carrying systems according to the present invention are typically, but not necessarily, adapted to be readily shed by the user while the waist belt or waist belt and support panel remain installed in place on the user. The waist belt may have other items installed thereupon, and the ability to readily shed the backpack or ballistic garment while keeping the waist belt and other items can be beneficial to the user. The other items can include, but are not limited to, grenades, explosives, ammunition, handguns, flashlights, navigation gear such as global positioning system devices, communication devices, or personal effects.

Embodiments include personal load-carrying systems in which the support panel tail portion sets relatively loosely within the panel pocket, while still supported by panel pocket. Accordingly, the backpack and waist belt are adapted to move relatively independently while being worn, with the waist belt nevertheless still supporting a portion of the backpack load that is transmitted to the waist belt via the support panel. In some embodiments, the support panel tail portion is readily removed from within the panel pocket while the personal load-carrying system is worn with a backpack or ballistic garment. Among other benefits, this feature can make the system more comfortable where a user is sitting, such as, but not limited to, while sitting in a vehicle.

Embodiments include personal load-carrying systems in which a ballistic garment and backpack are worn simultaneously, wherein the ballistic garment is typically worn beneath the backpack. Typically, such a configuration includes a waist belt having a first panel pocket bearing a first support panel with a tail portion of the first support panel residing within the first panel pocket. An upper portion of the first support panel resides in a sleeve coupled to the ballistic garment such that the weight of the ballistic garment is partially or fully carried by the first support panel. The ballistic garment further comprises a second panel pocket bearing a second support panel, a tail portion of the second support panel residing within the second pocket. An upper portion of the second support panel resides within a second sleeve coupled to the backpack such that the backpack load is partially or fully carried by the second support panel. Accordingly, the backpack load is transferred via the second support panel to the ballistic garment, and subsequently to the waist belt via the first support panel, such that the backpack load and the weight of the ballistic garment are at least partially borne by the waist belt.

In some embodiments, the support panel affords ballistic protection to the user. Support panels having a ballistic rating of IIIA are readily made using multiple layers of aramid sheets in combination with resin. The resins include, but are not limited to, phenolic, polyester, and epoxy resins. The aramid sheets include, but are not limited to, woven and non-woven fabric comprising aramid fibers. Embodiments of support panels typically comprise materials including, but not limited to, KEVLAR® and other aramid fiber material, polyethylene fiber, carbon fiber, ceramic plate, and metal plate. The polyethylene fiber typically, but not necessarily, comprises ultra high molecular weight polyethylene, including strand-oriented gel spun fibers such as DYNEEMA® and SPECTRA®. Materials comprising combinations of polyethylene fiber and polyester, including CUBEN FIBERTM™are also contemplated. For the purposes of this application and appended claims, aramid includes para-aramid, meta-aramid, and other long-chain synthetic polyamides in which at least 85% of the amide linkages, (—CO—NH —) are attached directly to two aromatic ring. Fabric includes both woven and non-woven fabric, mats, rovings, woven rovings, and combinations thereof.

Embodiments of the present invention include personal-load carrying systems comprising interchangeable waist belts, backpacks, support panels, and body armor. Embodiments also include modular pack compartments that detachably couple to a pack main compartment in order to increase or decrease pack volume enclosed by pack compartments. Accordingly, a relatively modest collection of modular load-carrying system components can result in pack assemblies that can be optimized for a wide variety of activities, without requiring a plethora of separate backpacks of different designs and capacities.

Terminology

The terms and phrases as indicated in quotation marks (“ ”) in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term “or” as used in this specification and the appended claims is not meant to be exclusive; rather the term is inclusive, meaning either or both.

References in the specification to “one embodiment”, “an embodiment”, “another embodiment, “a preferred embodiment”, “an alternative embodiment”, “one variation”, “a variation” and similar phrases mean that a particular feature, structure, or characteristic described in connection with the embodiment or variation, is included in at least an embodiment or variation of the invention. The phrase “in one embodiment”, “in one variation” or similar phrases, as used in various places in the specification, are not necessarily meant to refer to the same embodiment or the same variation.

The term “couple” or “coupled” as used in this specification and appended claims refers to an indirect or direct physical connection between the identified elements, components, or objects. Often the manner of the coupling will be related specifically to the manner in which the two coupled elements interact.

The terms “directly coupled” or “coupled directly,” as used in this specification and appended claims, refer to a physical connection between identified elements, components, or objects, in which no other element, component, or object resides between those identified as being directly coupled.

The terms “removable”, “removably coupled”, “removably disposed,” “readily removable”, “readily detachable”, “detachably coupled”, “separable,” “separably coupled,” and similar terms, as used in this specification and appended claims, refer to structures that can be uncoupled, detached, uninstalled, or removed from an adjoining structure with relative ease (i.e., non-destructively, and without a complicated or time-consuming process), and that can also be readily reinstalled, reattached, or coupled to the previously adjoining structure. For the purposes of this specification and appended claims, structures coupled to adjoining structures with PALS webbing are not considered to be removably or detachably coupled.

The term “approximately,” as used in this specification and appended claims, refers to plus or minus 10% of the value given.

The term “about,” as used in this specification and appended claims, refers to plus or minus 20% of the value given.

The terms “generally” and “substantially,” as used in this specification and appended claims, mean mostly, or for the most part.

Figure 3:
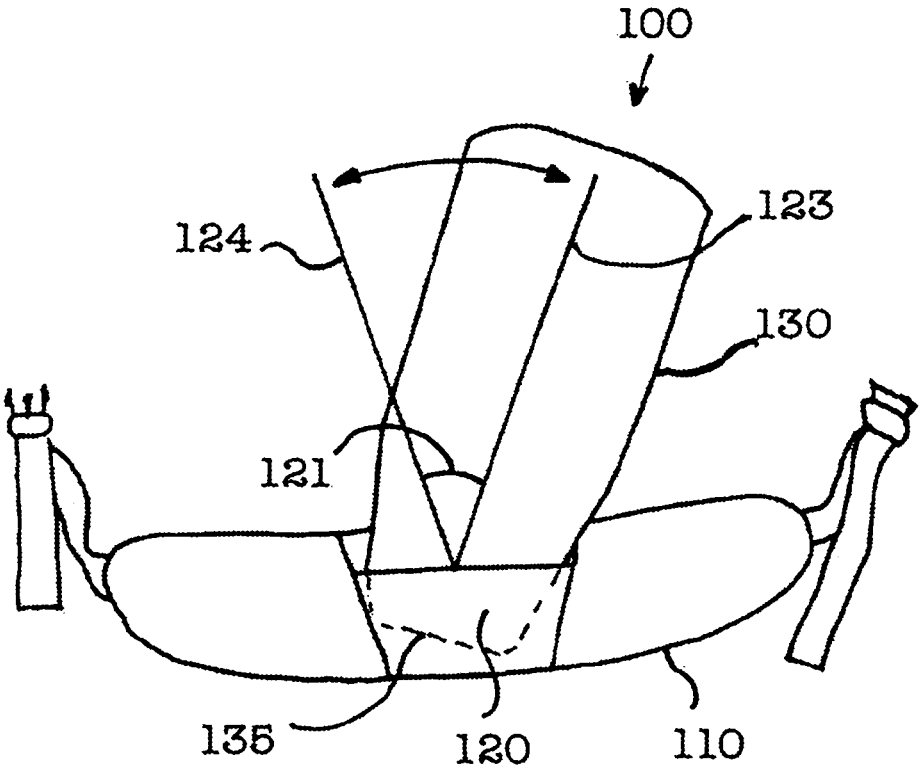
FIG. 3 is a side perspective view of a personal load-carrying system according to an exemplary embodiment of the present invention.

The term “lateral flex,” as used in this specification and appended claims, refers to degrees of rotation of a support panel about a rotational axis, while a tail portion of the support panel resides in a panel pocket of a waist belt, and the panel pocket bears the weight of the support panel or is adapted to bear the weight of the support panel, as shown in FIG. 3. The rotational axis is within 15° of horizontal and is parallel to a user's sagittal plane, or to a hypothetical user's sagittal plane where the hypothetical user stands upright and wears the personal load-carrying system in a normal upright configuration with the waist belt encircling the user's torso, with the support panel extending upwardly from within the waist belt panel pocket proximate the user's back, as shown in FIG. 1.

The term “substantially rigid,” as used in this specification and appended claims, refers to physical properties of support panels, and means stiff and dimensionally stable with a small amount of resilient flexibility. Substantially rigid support panels can flex slightly in response to a load, and return to their original shape after the load is removed, unless the support panel sustains structural damage.

The term “PALS webbing,” as used in this specification and appended claims, refers to a Pouch Attachment Ladder System grid of webbing. PALS is used by the United States armed forces and is familiar to persons skilled in the art.

The terms "ballistic rating" and similar terms, as used in this specification and appended clams, refer to ratings for Ballistic Resistant Protective Materials as identified by National Institute of Justice (NJI) Standard 0108.01.

The terms "ballistic garment" and "ballistic garments," as used in this specification and appended claims, refer to garments familiar to persons skilled in the art, adapted to provide protection to a portion of a user's torso and having a NJI ballistic rating of at least I. Ballistic garments include, but are not limited to, plated body armor, non-plated body armor, ballistic vests, and other garments worn to protect a wearer from projectiles.

Directional or relational terms such as "top," bottom," "front," "back," "above," and "below," as used in this specification and appended claims, refer to relative positions of identified elements, components, or objects, in a personal load-carrying system or components thereof, where the system or components are oriented as worn by a user in an upright position with a waist belt surrounding the user's torso. "Inside," "inward," and "inwardly" refer to a direction toward a user's torso or toward where the user's torso would reside if the system or components thereof were installed on the user in a normal position. Similarly, "outside," "outward," and "outwardly" refers to a direction away from a user's torso. Accordingly, the "inside" of a support panel refers to a side of the support panel facing a user's back or adapted to face a user's back if a waist belt and the support panel were installed on the user in a normal position.

A First Embodiment Personal Load-carrying System

Figure 2:
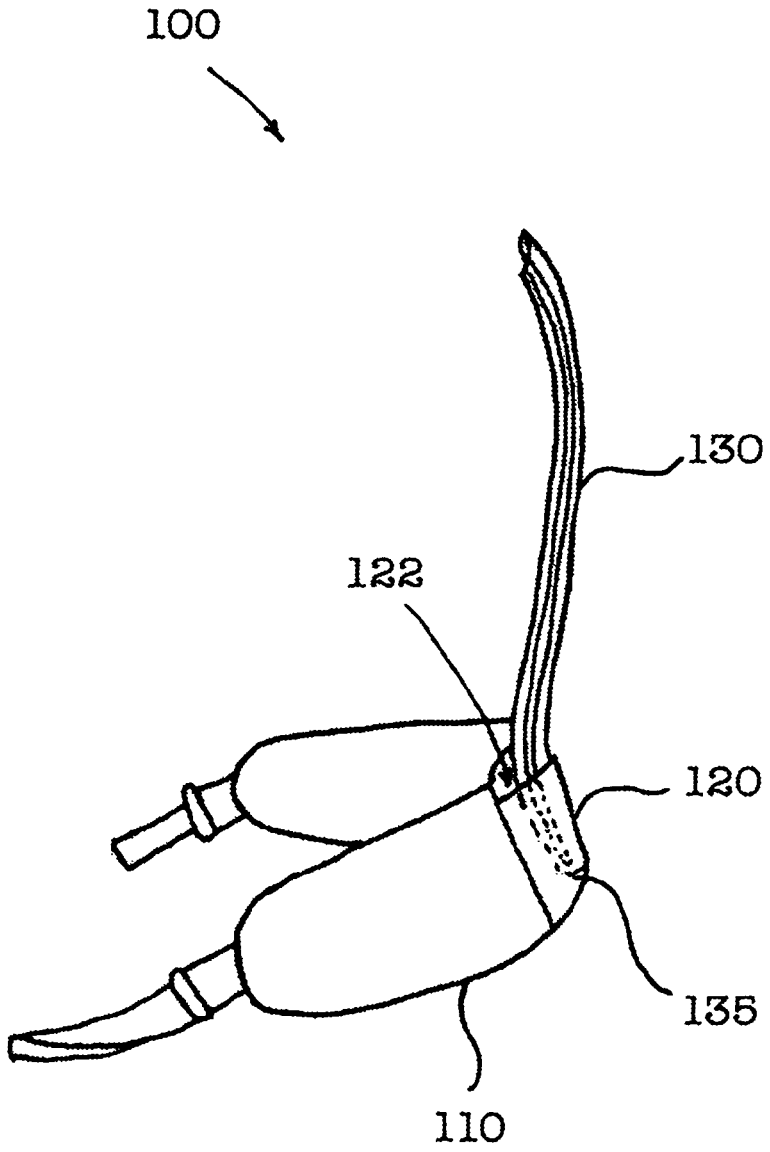
FIG. 2 is a back perspective view of a personal load-carrying system according to an exemplary embodiment of the present invention.

A first embodiment personal load-carrying system 100 is illustrated in FIGS. 1-3. The first embodiment personal load-carrying system comprises a waist belt 110 including a panel pocket 120 residing at a back portion of the waist belt. A support panel 130 sets in the panel pocket, with a tail portion 135 of the support panel (shown in hidden line) residing within the panel pocket. The support panel extends out of the panel pocket through a panel receiving aperture 122 residing at a panel pocket top. The panel receiving aperture 122 is upwardly opening in order to receive the tail portion 135 of the support panel 130.

The first embodiment waist belt 110 typically includes pads that are inserted into pockets that are integral with the waist belt. The pads can be inserted or removed to suit a user. Padding can be modulated by inserting more or less padding. Other pads can be removably affixed to the waist belt with hook and loop attachment means, or other releasable attachment. Embodiments include military style duty belts fitted with padding, which can enhance user comfort and make the duty belt better suited for supporting heavy loads.

The panel pocket 120 typically comprises supple material and the panel receiving aperture 122 extends completely across the panel pocket top. The supple material typically includes, but is not limited to, nylon or polyester fabric. Inside surfaces of the panel pocket can include polymeric sheets having relatively slick surfaces, which facilitate ready insertion or removal of a support panel. The polymeric sheets typically comprise a polyolefin such as, but not limited to, polyethylene and polypropylene. Embodiments of polymeric sheets can comprise other polymers, including but not limited to polyesters; acrylonitrile butadiene styrene (ABS); polyacrylonitrile; polystyrene; polyetheretherketone (PEEK); polyimides; polyamides; polycarbonates; epoxide polymers; polyvinyl chloride; acrylate and methacrylate polymers; fluorinated polymers including, but not limited to, polytetrafluoroethylene, polyfluoroethylenepropylene, poly(tetrafluoroethylene-co-hexafluoropropylene-co-vinylidene fluoride, and polyvinylidene fluoride; polychloropene; polyisoprenes; and polyurethanes.

Embodiments include panel pockets affixed to duty belts in order to adapt the duty belts to personal load-carrying systems of the present invention. The panel pockets can be removably or permanently coupled to the duty belts.

The support panel 130 of the first embodiment load-carrying system 100 is typically substantially rigid and comprises a laminate consisting essentially of twelve layers of KEVLAR ® sheet and polyester resin. The laminate is typically about 30% by weight polyester resin. The KEVLAR ® sheets are typically model 5745 KEVLAR ® fabric comprising 3000 denier Kevlar 29, from BFG™Industries, Inc. (Greensboro, N.C.). Other resins, including but not limited to epoxy resins, are contemplated. However, ballistic support panels comprising KEVLAR ® sheets and resin typically show better ballistic performance with polyester resin than with epoxy resin.

The first embodiment support panel, comprising twelve layers of KEVLAR ® fabric and about 30% by weight polyester resin as described above, meets standards for a ballistic rating of at least IIIA. Embodiments of the support panels have a ballistic rating preferably at least I, more preferably at least II, and most preferably at least IIIA. Support panels having ballistic ratings of III or IV are contemplated. Lighter weight support panels typically include fewer aramid sheets and have lower ballistic rating. In some embodiments, aramid sheets are combined with carbon fiber sheets. Some embodiments do not include aramid sheets, and some support panels do not have a ballistic rating. Embodiments of support panel include, but are not limited to, corrugated material comprising thermoplastic or thermoset polymers, planar panels comprising synthetic polymers, and composites comprising glass or carbon fibers in resin. Some embodiments include combinations of carbon fiber fabric, aramid fabric, and epoxy or polyester resin. Support panels comprising polyolefin fibers (typically, but not necessarily, polyethylene) achieve ballistic ratings of up to IIIA and are generally lighter weight than aramid based support panels.

The first embodiment support panel 130 is generally S-shaped, being inwardly curved at a lower half of the support panel, and outwardly curved at an upper half of the support panel. For the purposes of this specification and appended claims, "inwardly curved" means having a convex surface facing inwardly, i.e. toward a user's body or toward where a user's body would reside during normal use. Similarly, "outwardly curved" means having a convex surface facing outwardly, i.e. away from a user's body or away from where a user's body would reside during normal use. Where the first embodiment personal load-carrying system is worn normally, the inwardly curved lower half of the support panel typically resides proximate a user's lower back, and the outwardly curved upper half resides proximate a user's shoulder blades. Accordingly, the S-shaped support panel of the first embodiment conforms roughly to the shape of a user's back.

Embodiments of support panel are typically, but not necessarily, ribbed in order to increase stiffness and enhance ventilation. The first embodiment support panel 130 includes three ribs 132.

The first embodiment panel receiving aperture 122 is typically about 9.0 inches across. When the support panel 130 is fully inserted in the panel pocket 120, the support panel is approximately 8.0 inches across along a line where the support panel emerges from the panel pocket. Thus the support panel can pivot about a point proximate the tail portion.

Accordingly, as shown in FIG. 3, the support panel 130 can rotate approximately 36° about a rotational axis, as represented by a first angle 121, while the tail portion 135 remains within the panel pocket 120. The first angle is an angle between a first axis 123 and a second axis 124. The rotational axis is within 15° of horizontal and is parallel to a user's sagittal plane. The rotation can be referred to as lateral flex, and occurs with the tail portion 135 remaining generally within the panel pocket 120, with the panel pocket thus adapted to bear the weight of the support panel 130 during the lateral flex. The first axis 123 resides at a rightward limit of rotation for a support panel longitudinal axis disposed at a center of the support panel, as seen in FIG. 3, where the support panel longitudinal axis is tilted approximately plus 18° from vertical. The second axis 124 resides at a leftward limit of rotation for the support panel longitudinal axis, where the support panel longitudinal axis is tilted approximately minus 18° from vertical.

Embodiments of support panels and waist belts have preferably at least 9° of lateral flex, more preferably at least 18° of lateral flex, still more preferably between 18° and 36° of lateral flex, and most preferably about 36° of lateral flex. Greater lateral flex typically gives a user greater freedom of movement and makes the system more comfortable.

Support panels are generally at least 4 inches across where the support panels emerge from a waist belt panel pocket, in order to distribute load across a relatively broad area. The relatively broad load distribution tends to increase user comfort. Accordingly, where a support panel is fully inserted into a panel pocket with a tail portion residing in the panel pocket, the support panel is preferably at least 4 inches across, more preferably between 6 inches and 14 inches across, and most preferably about 8.0 inches across, where the support panel emerges from the panel pocket.

A Second Embodiment Personal Load-Carrying System

Figure 4:
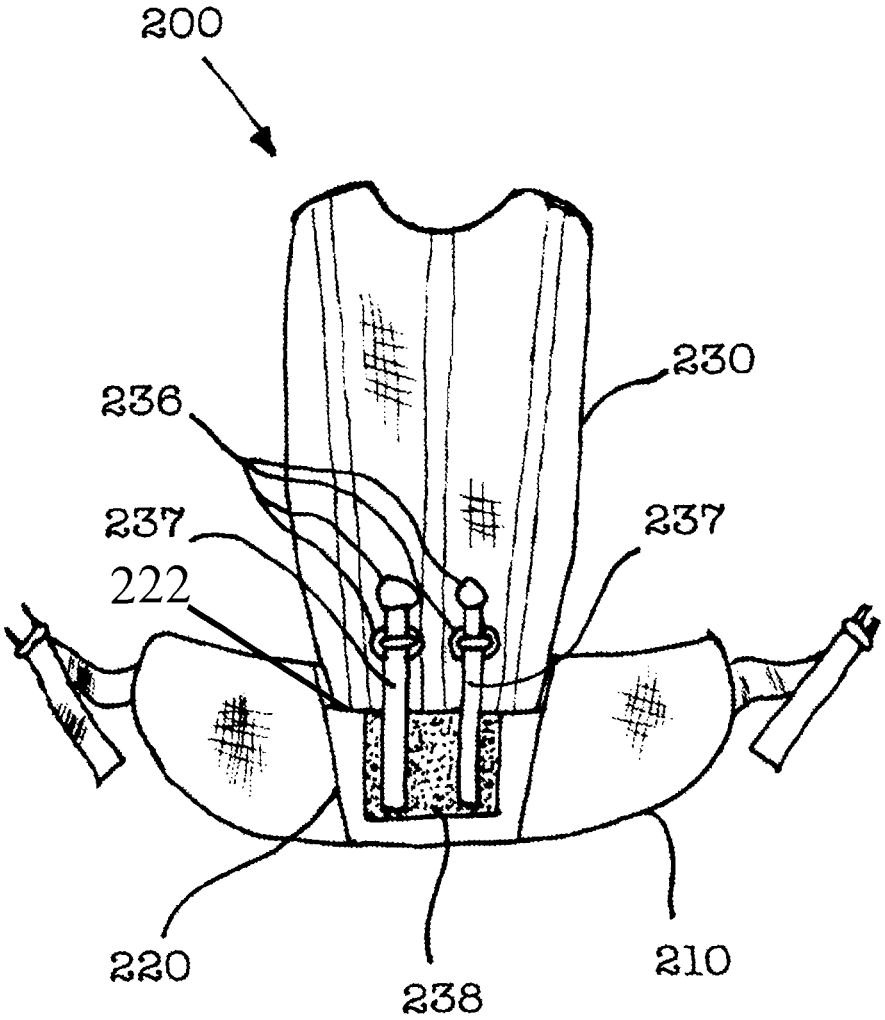
FIG. 4 is a back perspective view of a personal load-carrying system according to an exemplary embodiment of the present invention.

A second embodiment personal load-carrying system 200 is illustrated in FIG. 4. The second embodiment personal load-carrying system comprises a waist belt 210 including a panel pocket 220. A support panel 230 is borne by the panel pocket, with a tail portion of the support panel residing within the panel pocket. The support panel extends out of the panel pocket through a panel receiving aperture 222 residing at a pocket top. The support panel 230 is typically substantially rigid and consists essentially of a carbon fiber fabric and epoxy resin laminate.

The second embodiment personal load-carrying system 200 further comprises a panel attachment assembly that helps secure the support panel 230 in the panel pocket 220. The panel attachment assembly typically includes hook and loop straps 237 that couple directly to the support panel through strap apertures 236, and also couple directly to a hook and loop patch 238 disposed at a back portion of the waist belt. Embodiments include support panels having multiple apertures designed to reduce weight or increase ventilation. The panel attachment assembly can be readily disengaged by a wearer while the second embodiment personal load-carrying system is worn. Accordingly, the wearer can readily shed the secondary panel after disengaging the panel attachment assembly, while keeping the waist belt in place around the wearer's torso. Typically, but not necessarily, the wearer sheds the support panel while shedding a backpack or ballistic garment installed on the support panel.

A Third Embodiment Personal Load-Carrying System

Figure 5:
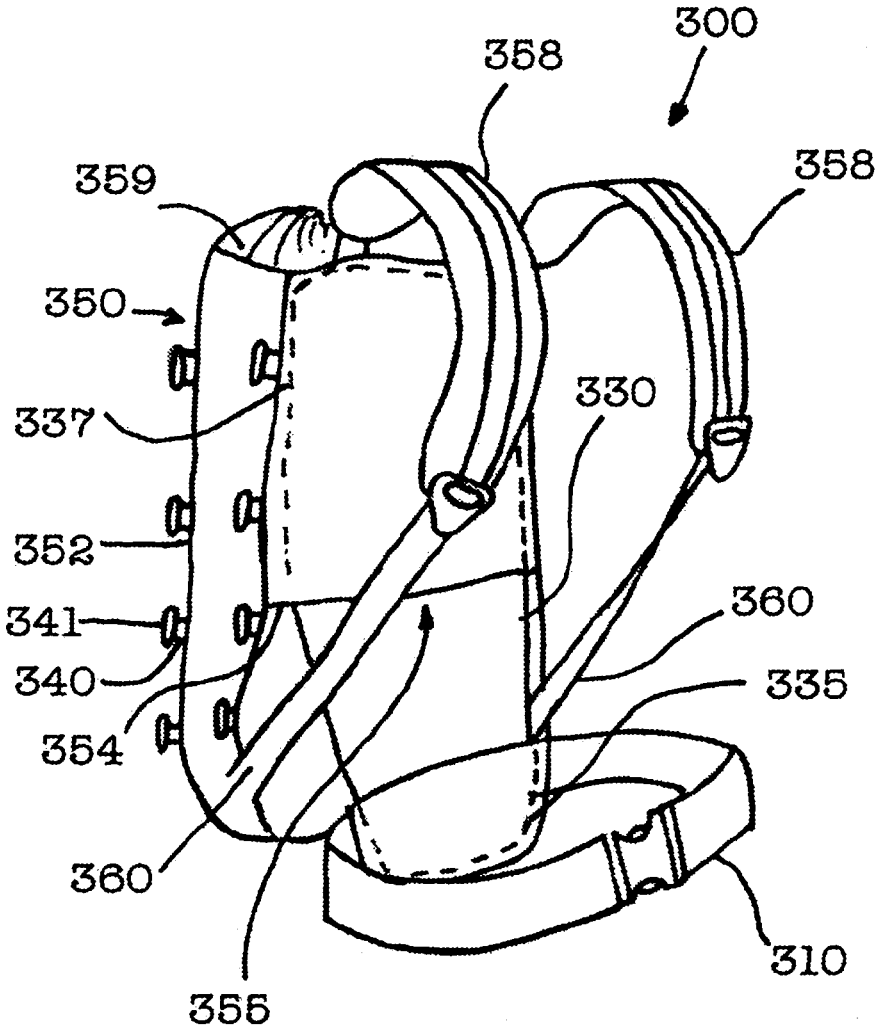
FIG. 5 is a front perspective view of a personal load-carrying system according to an exemplary embodiment of the present invention.
Figure 6:
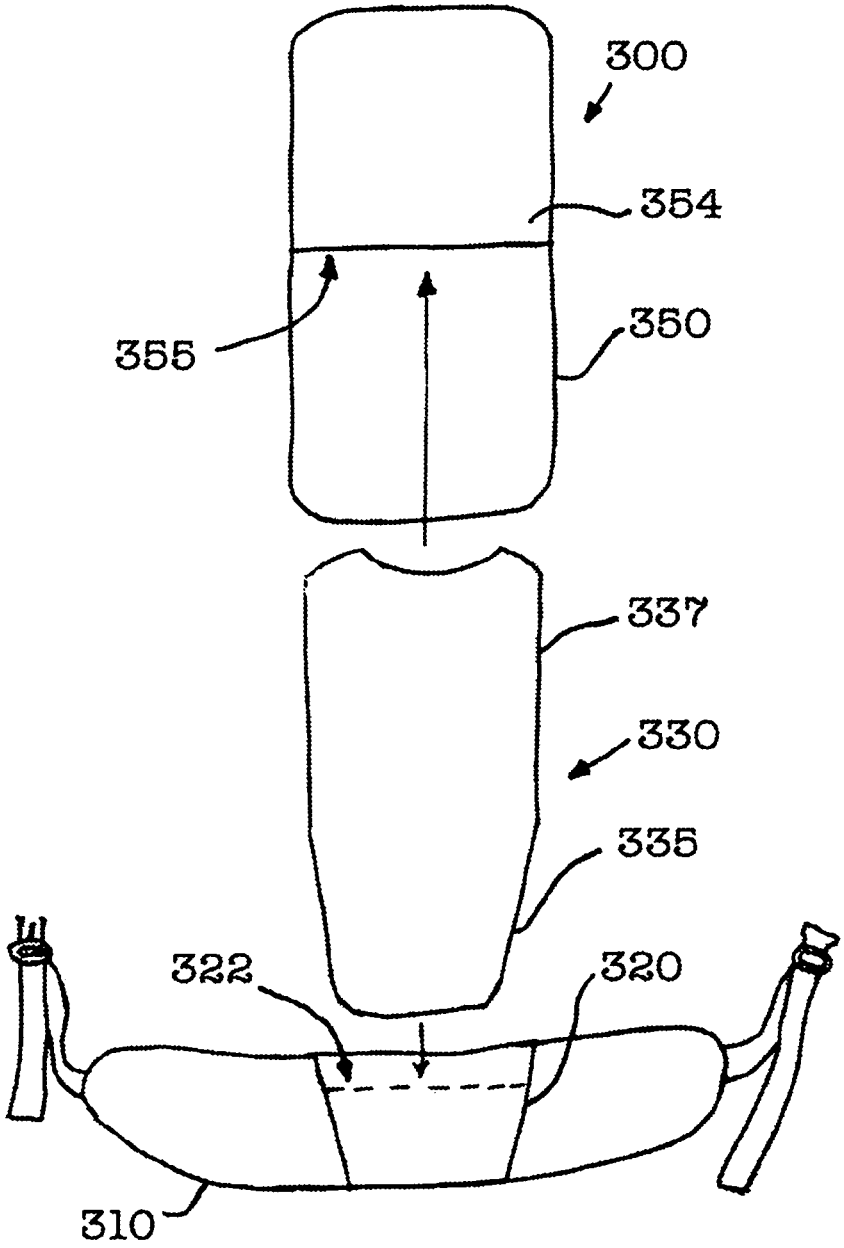
FIG. 6 is an exploded, back perspective view of a personal load-carrying system according to an exemplary embodiment of the present invention.

A third embodiment personal load-carrying system 300 is illustrated in FIGS. 5 and 6. The third embodiment personal load-carrying system comprises a waist belt 310 including a panel pocket 320 (not visible in FIG. 5). A support panel 330 is borne by the panel pocket, with a tail portion 335 of the support panel residing within the panel pocket. The support panel extends out of the panel pocket through a panel receiving aperture (not visible in FIG. 5) residing at a pocket top.

A backpack 350 comprising a pack main body 352, a pack upper sleeve 354, and shoulder straps 358, is installed on the support panel 330 with an upper portion 337 of the support panel 330 residing within the pack upper sleeve 354. The pack shoulder straps 358 are directly coupled to the pack main body 352 at upper anchor points 359 residing proximate a pack top. Only one of two anchor points is visible in FIG. 5. The pack shoulder straps 358 are also coupled directly to the pack main body 352 at lower anchor points 360. The pack shoulder straps are not coupled directly to the waist belt 310 or to the support panel 330, which facilitates ready removal of the backpack from a wearer while the waist belt or waist belt and support panel remain with the user. In some embodiments, the pack shoulder straps are coupled directly to the backpack by attachment means disclosed in U.S. Pat. No. 5,005,744, issued Apr. 9, 1991, and incorporated herein by reference.

The pack upper sleeve 354 of the third embodiment personal load-carrying system 300 is about 12.0 inches tall, and about 11.75 inches of the support panel 330 resides therein. In some embodiments, such as but not limited to embodiments including an All-Purpose Lightweight Individual Carrying Equipment (ALICE) backpack such as is used by the United States Armed Forces, a pack upper sleeve is about 4.5 inches tall and receives about 4.5 inches of support panel therein. Accordingly, the backpack of the third embodiment personal load support system is more securely coupled to the support panel than where an ALICE backpack is used. Variations of personal load-carrying systems include pack upper sleeves that are preferably greater than 3 inches tall, more preferably between 3 inches and 16 inches tall, and still more preferably between 4 inches and 12 inches tall.

Pack upper sleeves 354 of the third embodiment backpack 350 and of ALICE backpacks have pack upper sleeve panel receiving apertures 355 about 11.5 inches across, which are thus adapted to readily receive first, second, and third embodiment support panels 130, 230, 330. Pack upper sleeve panel receiving apertures are typically downwardly facing. The support panel 330 of the third embodiment is about 10 inches across at its upper portion widest section, which resides within the pack upper sleeve 354 when the backpack 350 is installed on the support panel 330. Variations of support panels have upper portion widest sections that are preferably less than 13 inches across, more preferably less than 11.5 inches across, still more preferably between 6 inches and 11.5 inches across, and most preferably about 9.5 inches across.

The third embodiment backpack 350 is slidably coupled to the support panel 330, and hence to the waist belt 310, as follows. The pack upper sleeve 354 is adapted to slide vertically on the support panel 330, which permits the backpack 350 to move upwardly away from the waist belt 310, while the personal load-carrying system is worn and the backpack remains coupled to the waist belt through the support panel, which remains at least partially received within the pack upper sleeve during the upward movement. The backpack 350 is similarly adapted to move downwardly toward the waist belt 310 as the pack upper sleeve 354 slides on the support panel 330 until the support panel upper portion 337 is fully received within the pack upper sleeve 354. The slidable coupling described above enables a user to enjoy the benefit of greater range of motion and comfort, compared to backpacks that are fixedly coupled to a waist belt. Ballistic garments are also typically slidably coupled to support panels and waist belt by the mechanism described above.

FIG. 6 illustrates the third embodiment personal load carrying system 300 with the support panel 330 separated from the backpack 350 and the waist belt 310. As seen in FIG. 6, the backpack includes the pack upper sleeve 354, which is adapted to receive the upper portion 337 of the support panel 330 through the pack upper sleeve panel receiving aperture 355. Similarly, the waist belt 310 includes the panel pocket 320, which is adapted to receive the tail portion 335 of the load support panel 330 through the panel receiving aperture 322 of the panel pocket.

As best seen in FIG. 5, the backpack 350 of the third embodiment load carrying system 300 includes multiple auxiliary attachment assemblies, each of which comprises a first webbing loop 340 coupled directly to a ring 341. The ring typically, but not necessarily, comprises metal or other rigid or semi-rigid material. The auxiliary attachment assemblies of the third embodiment are adapted to engage a second webbing loop in order to create a coupling. The coupling is created by the second webbing loop passing though the ring and being reversibly secured to prevent the second webbing loop from slipping out of the ring. The second webbing loop can be reversibly secured with structures such as, but not limited to, a carabiner, a rope or cord, or a wand. In some embodiments, the second webbing loops of multiple couplings are reversibly secured with a single rope or wand. The multiple couplings can thus be very quickly uncoupled by withdrawing the single rope or wand, resulting in quick release functionality.

The third embodiment support panel upper portion is sized to be received within pack upper sleeves of small, medium, and large size ALICE backpacks used by United States Armed Forces, and of more recently employed MOLLE (Modular Lightweight Load-carrying Equipment) based backpacks used by the Armed Forces. After having switched from ALICE backpacks and frames to more modern MOLLE backpacks and frames, the United States Marines are now sometimes favoring the older ALICE backpacks, combined with alternative frames, because the Marines find that both ALICE and MOLLE frames tend to break during extremely demanding use, but the ALICE pack is adapted for use with alternative frames that are more durable. The extremely demanding use includes where Marines perform parachute assisted descents with fully loaded backpacks. Accordingly, support panels that readily interface with ALICE backpacks appeal to the Marines.

A Fourth Embodiment Personal Load-Carrying System

Figure 7:
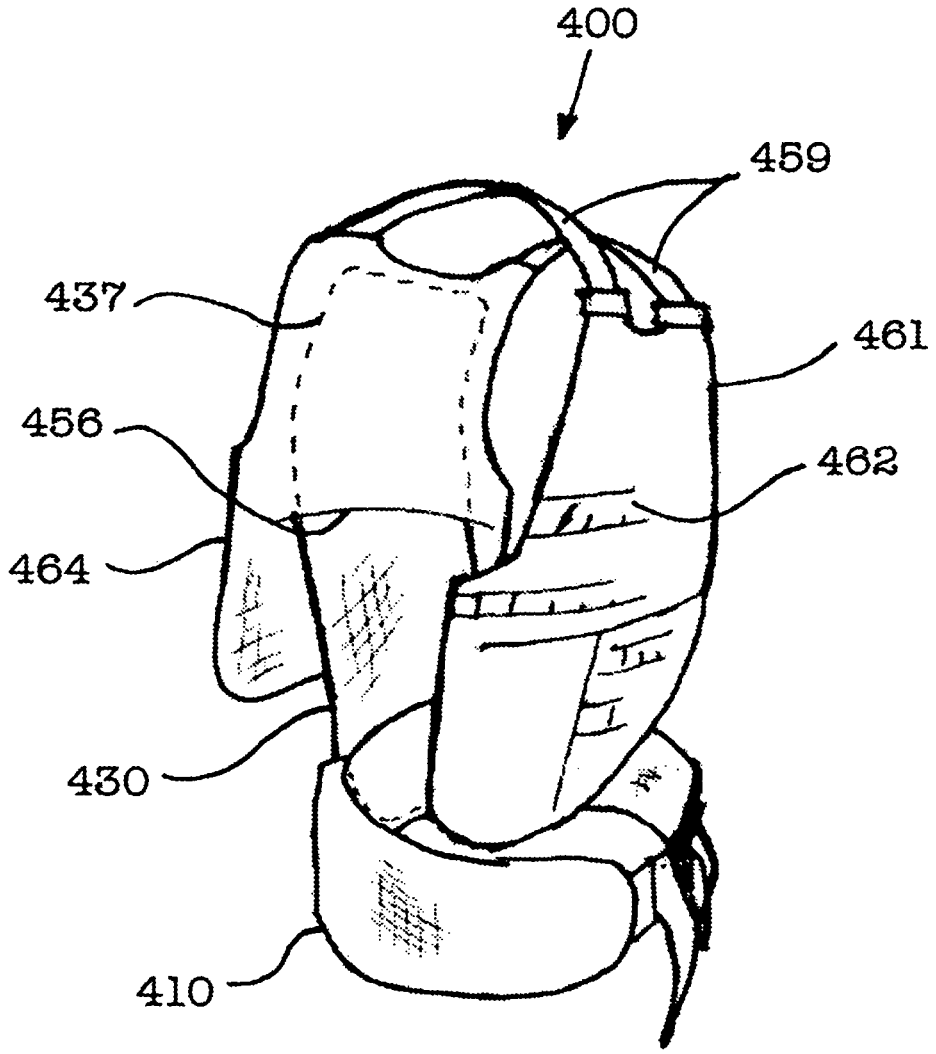
FIG. 7 is a side, front perspective view of a personal load-carrying system according to an exemplary embodiment of the present invention.
Figure 8:
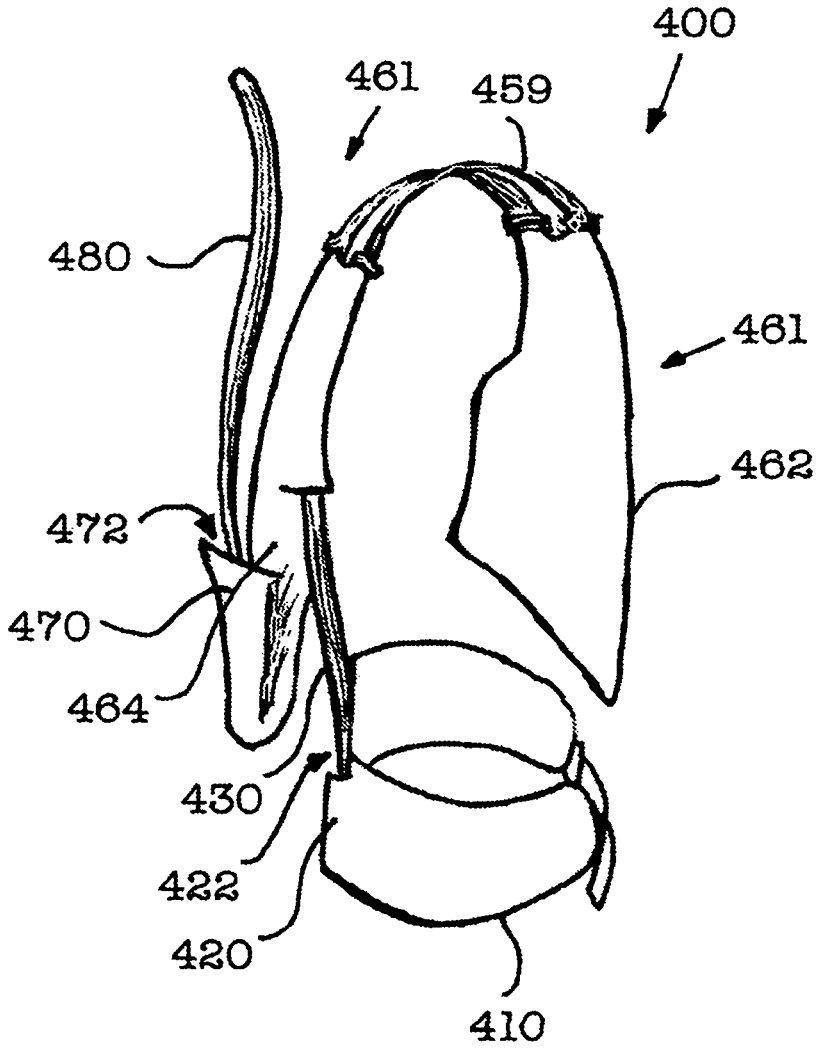
FIG. 8 is a side, perspective view of a personal load-carrying system according to an exemplary embodiment of the present invention.
Figure 9:
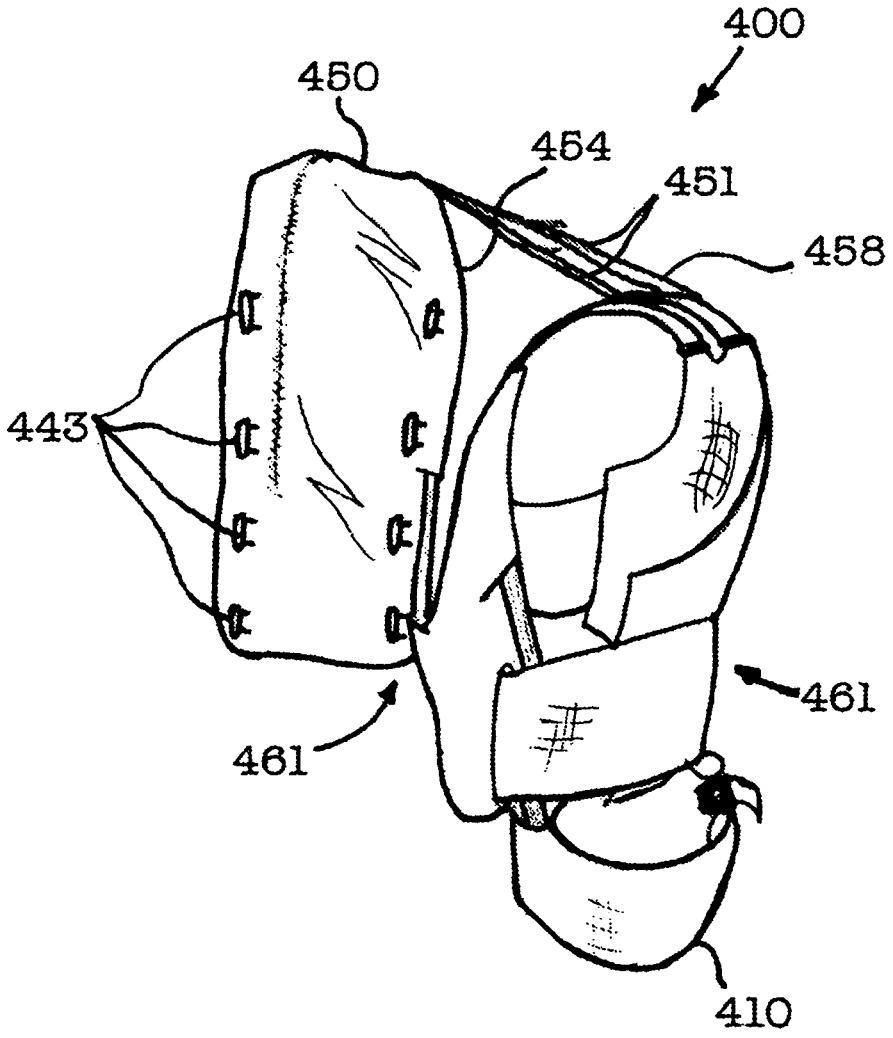
FIG. 9 is a side, perspective view of a personal load-carrying system according to an exemplary embodiment of the present invention.

A fourth embodiment personal load-carrying system 400 is illustrated in FIGS. 7-9. The fourth embodiment personal load-carrying system comprises a waist belt 410 including a first panel pocket 420. A first support panel 430 sets in the first panel pocket, with a tail portion of the first support panel residing within the first panel pocket. The first support panel extends out of the first panel pocket through a panel receiving aperture 422 residing at a pocket top.

A ballistic garment 461 comprising a front panel 462 coupled to a back panel 464 by garment shoulder straps 458. The ballistic garment of the fourth embodiment is a ballistic vest. The ballistic vest further comprises a garment upper sleeve 456, within which resides an upper portion 437 of the first support panel 430. The garment shoulder straps 458 are directly coupled to the front and back panels 462, 464. The garment shoulder straps 458 are not coupled directly to the waist belt 410 or the first support panel 430, which facilitates ready removal of the ballistic vest from a wearer while the waist belt or waist belt and first support panel remain with the user.

The backpack 350 of the third embodiment personal load-carrying system 300 is interchangeable with the ballistic vest 461 of the fourth embodiment personal load-carrying system 400. Accordingly, the third embodiment support panel 330 can be readily removed from within the pack upper sleeve 354 in order to remove the backpack 350, and the ballistic garment 461 can be readily installed on the third embodiment support panel 330 in place of the backpack 350, with the third embodiment support panel 330 residing within the garment upper sleeve 456.

As best seen in FIG. 8, the ballistic garment 461 of the fourth embodiment load-carrying system 400 further comprises a second pocket 470. A second support panel 480 sets in the second pocket and extends out of the pocket through an upwardly facing second pocket panel receiving aperture 472. The first support panel 430 and second support panel 480 are typically, but not necessarily, identical, and are thus interchangeable.

As best seen in FIG. 9, the fourth embodiment load-carrying system 400 further comprises a backpack 450. The backpack includes a pack upper sleeve 454 within which resides an upper portion of the second support panel (not visible in FIG. 9). FIG. 9 also shows load lift members 451 that facilitate lifting the backpack. The load lift members are typically straps or loops of webbing securely sewn or otherwise attached to the shoulder straps 458.

A substantial portion of the backpack load is supported by the second support panel 480, which is in turn supported by the second pocket 470 and ballistic garment 461 on which the second pocket resides. Backpack load refers to weight of a backpack, including pack contents and items suspended from the backpack. The ballistic garment is supported by the first support panel 430, which is in turn supported by the first panel pocket 420 and the waist belt 410. A burden comprising both a portion of ballistic garment weight and a portion of backpack load and is therefore transferred to a user's hips, thus sparing the user's back from the burden. The backpack 450 further comprises auxiliary attachment assemblies 443, each comprising a webbing loop coupled to a metal ring.

Figure 10:
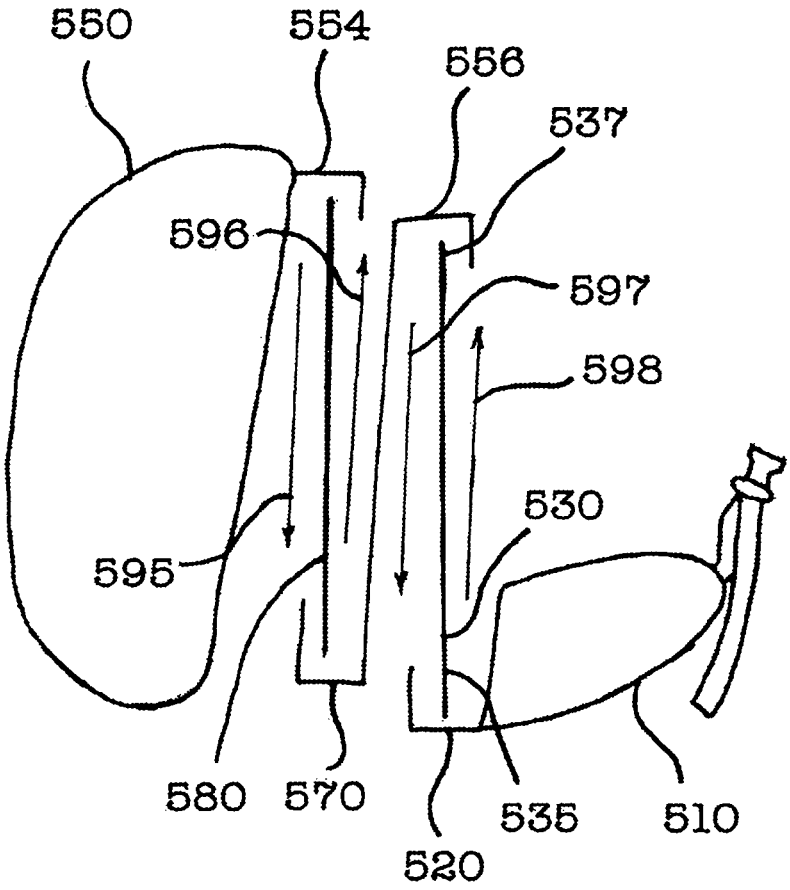
FIG. 10 is a schematic diagram showing a side view of a personal load-carrying system according to an exemplary embodiment of the present invention.

FIG. 10 is schematic diagram showing directions of load forces and support forces for embodiments of personal load-carrying systems such as the fourth embodiment illustrated in FIG. 9. As shown in FIG. 10, a waist belt 510 includes a first panel pocket 520, which supports a first support panel 530. A tail portion 535 of the first support panel resides in the first panel pocket and an upper portion 537 resides in an upper sleeve 556 of a ballistic garment. The ballistic garment further comprises a second pocket 570 within which sets a second support panel 580. A backpack 550 is coupled to the second support panel by a pack upper sleeve 554.

A secondary load arrow 595 indicates a generally downward force exerted by the backpack 550 on the second support panel 580. A secondary support arrow 596 indicates a generally upward force exerted by the second support panel, the generally upward force of the second support panel countering the generally downward force of the backpack. A primary load arrow 597 indicates a generally downward force exerted by the ballistic garment, and also by the backpack load, which has been transmitted to the ballistic garment. A primary support arrow 598 indicates a generally upward force exerted by the first support panel.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

For example, embodiments include systems comprising a lightweight backpack with a 30 liter compartment, to which is removably coupled shoulder straps and a light duty waist strap. The light duty waist strap is unpadded and comprises one inch nylon webbing and a quick release buckle, for instance a FASTEX™buckle, or similar buckle. The system also includes a medium to heavy duty padded waist belt, a support panel, and a 70 liter compartment. The lightweight backpack is removably coupled directly to the support panel, which is removably coupled directly to the padded waist belt. The support panel removably couples directly to the lightweight backpack by engaging a pack sleeve adapted to receive the support panel therein. The waist belt comprises a first panel pocket, in which the support panel rests to removably couple the support panel to the waist belt.

For a long day hike or overnight trip, where a user carries a load of preferably 15-35 pounds and more preferably about 27 pounds, the user wears the lightweight backpack with the support panel and the padded waist belt. For a multi-day trip where a heavier load is carried, the lightweight backpack is removed from the support panel and padded waist belt, and the 70 liter compartment is installed on the support panel, with the support panel engaging the 70 liter compartment via a pack sleeve similar to that of the lightweight 30 liter backpack. The shoulder straps are removed from the 30 liter backpack and installed on the 70 liter compartment to provide a relatively heavy duty rig for carrying a load that is preferably greater than 27 pounds, more preferably greater than 35 pounds, and most preferably between 35 and 55 pounds. In some embodiments, the shoulder straps are adapted to be installed on the support panel or the compartment/backpack.

In some embodiments, a larger support panel is used with the 70 liter compartment, the larger support panel and 70 liter compartment being used with the same padded waist belt. The padded waist belt comprises pockets adapted to receive additional padding for carrying heavier loads. Embodiments include additional padding comprising ELASTO-GEL™material (e.g., a hydrogel being a compound water soluble humectant entrapped within a polymeric matrix of acrylamide) from Southwest Technologies, Inc. Other additional padding includes open and closed cell padding.

Variations include personal load-carrying systems comprising a support panel removably coupled to a waist belt with a quick release coupling. The support panel of the second embodiment is adapted to engage a garment sleeve on a ballistic vest or a pack sleeve on a backpack; and thereby couple the support panel to the ballistic vest or to the back pack. The quick release coupling comprises an engagement rod that threads through belt coupling loops and support panel loops to couple the support panel to the waist belt. The engagement rod can be readily pulled from the support panel and belt coupling loops to quickly release the belt from the framesheet.

In some embodiments, the waist belt includes both a pocket adapted to receive a first support panel and a quick release coupling adapted to couple a second support panel to the waist belt. The waist belt is thus equipped to support a ballistic vest with the first framesheet. If and when the user needs to also carry a backpack, the second support panel can be quickly connected to the waist belt and the backpack installed on the second support panel, without removing the ballistic vest.

In some embodiments, a personal load-carrying system comprises a padded waist belt that includes a pocket within which is partially received a support hoop. The support hoop is adapted to engage a backpack or body armor, and thereby transfer the load of carrying the backpack or body armor to a user's hips.

I claim:

1. A personal load-carrying system comprising:

a waist belt including a panel pocket disposed at a back portion of the waist belt and having a panel receiving aperture residing at a top portion of the panel pocket;

a substantially rigid support panel including:

a tail portion removably disposed in the panel pocket;

an upper portion residing above the tail portion;

a backpack including:

a pack main body;

a pack upper sleeve disposed at a top portion of the pack main body, the pack upper sleeve including a panel receiving aperture residing at a bottom portion of the pack upper sleeve, and the upper portion of the support panel being removably disposed in the pack upper sleeve; and at least one shoulder strap coupled directly to the backpack at an upper anchor and at a lower anchor, the upper anchor residing at a top portion of the backpack and the lower anchor residing below the upper anchor.

2. The personal load-carrying system of claim 1, wherein the support panel has a ballistic rating of at least I.

3. The personal load-carrying system of claim 2, wherein the support panel has a ballistic rating of at least IIIA.

4. The personal load-carrying system of claim 1, wherein the support panel has at least 9° of lateral flex.

5. The personal load-carrying system of claim 1, wherein the support panel further comprises multiple sheets comprising fibers selected from the group consisting of aramid fiber, carbon fiber, and polyolefin fiber.

6. The personal load-carrying system of claim 5, wherein the support panel further comprises a resin selected from the group consisting of phenolic resin, polyester resin, and epoxy resin.

7. The personal load-carrying system of claim 1, wherein the support panel further includes an inwardly curved portion residing at a lower half of the of the support panel and an outwardly curved portion residing at an upper half of the support panel.

8. The personal load-carrying system of claim 1, wherein the backpack is selected from the group consisting of an All-Purpose Lightweight Individual Carrying Equipment (ALICE) backpack and a Modular Lightweight Load-carrying Equipment (MOLLE) backpack.

9. The personal load-carrying system of claim 4, wherein a widest section of the load support upper portion residing in the pack upper sleeve is less than 11.5 inches across.

10. The personal load-carrying system of claim 1, wherein the backpack is designed and adapted to be worn in the absence of the support panel and the waist belt.

11. The personal load-carrying system of claim 1, further comprising a ballistic garment and a garment sleeve, the garment sleeve:

being integral with or directly coupled to the ballistic garment;

being disposed at a top portion of the ballistic garment;

including a panel receiving aperture residing at a bottom portion of the garment sleeve; and being adapted to receive the upper portion of the support panel.

12. The personal load-carrying system of claim 11, wherein:

the backpack is adapted for ready removal from the support panel; and the ballistic garment is adapted for installation on the support panel with the upper portion of the support panel residing in the garment sleeve.

13. The personal load-carrying system of claim 11, wherein the garment sleeve is coupled to the ballistic garment with Pouch Attachment Ladder System (PALS) webbing.

14. The personal load-carrying system of claim 12, wherein the garment sleeve is detachably coupled to the ballistic garment.

15. A method of using the load-carrying system of claim 1, the method comprising:

wearing the load-carrying system with the support panel bearing a portion of a backpack load.

16. The method of claim 15, wherein the waist belt bears at least 25% of the backpack load.

17. A method of wearing the personal load-carrying system of claim 1, the method comprising:

wearing the load-carrying system with the support panel transmitting a portion of a backpack load to the waist belt; and removing the backpack while continuing to wear the waist belt.

18. A personal load-carrying system comprising:

a waist belt including a panel pocket disposed at a back portion of the waist belt and having a panel receiving aperture residing at a top portion of the panel pocket;

a substantially rigid support panel including:

a tail portion removably disposed in the panel pocket;

an upper portion residing above the tail portion;

a ballistic garment including a garment sleeve disposed at a top portion of the ballistic garment, garment sleeve including a garment receiving aperture residing at a bottom portion of the garment sleeve, and the upper portion of the support panel being removably disposed in the garment sleeve.

19. A personal load-carrying system comprising:

a waist belt including a first panel pocket disposed at a back portion of the waist belt and having a panel receiving aperture residing at a top portion of the first panel pocket;

a first support panel including:

a tail portion removably disposed in the first panel pocket;

an upper portion disposed above the tail portion;

a ballistic garment including:

a garment sleeve disposed at a top portion of the ballistic garment, the garment sleeve including a panel receiving aperture residing at a bottom portion of the garment sleeve, the upper portion of the support panel being removably disposed in the garment sleeve;

a second panel pocket disposed at a bottom portion of the ballistic garment;

a second support panel including:

a tail portion removably disposed in the second panel pocket;

an upper portion disposed above the second panel pocket tail portion;

a backpack including:

a pack upper sleeve disposed at a top portion of the backpack, the pack upper sleeve including a panel receiving aperture residing at a bottom portion of the pack upper sleeve, and the upper portion of the second support panel being removably disposed in the pack upper sleeve; and at least one shoulder strap coupled directly to the backpack.

20. The method of claim 15, further comprising:

removing the load-carrying system;

detaching the backpack by removing the support panel upper portion from the upper pack sleeve of the backpack;

inserting the support panel upper portion into a garment sleeve of a ballistic garment; and wearing the load-carrying system with the ballistic garment;

wherein the waist belt bears a portion of a ballistic garment weight.

* * * * *